US005590494A

United States Patent [19]

Miller

[11] Patent Number: 5,590,494

[45] Date of Patent: Jan. 7, 1997

[54] SUPPORT FOUNDATION FOR A BUILDING STRUCTURE

[76] Inventor: Gerald Miller, Box 102, Mankota Saskatchewan, Canada, S0H 2W0

[21] Appl. No.: 372,923

[22] Filed: Jan. 17, 1995

[51] Int. Cl.[6] ..... E02D 27/28

[52] U.S. Cl. ..... 52/169.9; 52/126.6; 248/156

[58] Field of Search ..... 52/169.9, 126.6; 248/545, 530, 156, 357, 158, 188; 405/229

[56] References Cited

U.S. PATENT DOCUMENTS 3,606,231 9/1971 Kilborn ..... 248/357 X 4,581,863 4/1986 Thaler ..... 52/126.6 X 4,598,510 7/1986 Wagner, III ..... 52/126.6

*Primary Examiner*—Carl D. Friedman

*Assistant Examiner*—W. Glenn Edwards

*Attorney, Agent, or Firm*—Adrian D. Battison; Murray E. Thrift

[57] ABSTRACT

A support foundation for a building structure includes a channel member at the upper end of a support post for receiving a joist. The support post is adjustable in length by a nut on a threaded rod which slides within a sleeve the lower end of which is welded to a base pad of the foundation. The sleeve is supported by inclined struts. The base is domed with a concave lower surface which maintains soil underneath the surface to inhibit tilting or sinking.

8 Claims, 1 Drawing Sheet

SUPPORT FOUNDATION FOR A BUILDING STRUCTURE

BACKGROUND OF THE INVENTION

This invention relates to a support foundation for a building structure including a base pad and a support member standing upwardly from the base pad such that the base pad can be simply located on the soil surface and the support member can carry the load of the building structure applied to an upper end of the support member.

SUMMARY OF THE INVENTION

It is one object of the present invention, therefore, to provide a support foundation which can be simply placed upon a soil surface which is shaped to avoid tilting or sinking of the base pad into the soil and allows adjustment of the height of the building structure relative to the base pad so that the building structure can be simply placed on the ground surface using the support foundation without the necessity for piles or other excavation.

According to one aspect of the invention there is provided a support foundation for a building structure comprising a base pad and an upstanding support member attached to the base pad, the support pad member including a threaded rod, a sleeve slidable over the threaded rod and a nut on the threaded rod for locating an end of the sleeve to adjust a height of the support member relative to the base pad, the base pad being circular in plan view having a domed shape to define a convex upper surface and a concave lower surface for resting on a soil surface.

The simple base pad member as defined above provides a stable support on the soil surface in view of the concave shape of the bottom surface of the pad which thus confines soil underneath the pad to restrict soil from flowing outwardly beyond one edge of the pad. In this way the pad is resistant to tilting and is also resistant to sinking within the soil. However the adjustment system provided by the sleeve and threaded rod allows the height of the building structure to be adjusted to accommodate any minor movements.

The device of the present invention therefore avoids the necessity for excavations for piles or similar complex building elements thus reducing the cost of the building structure and avoiding the difficulties of excavation in restricted areas.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
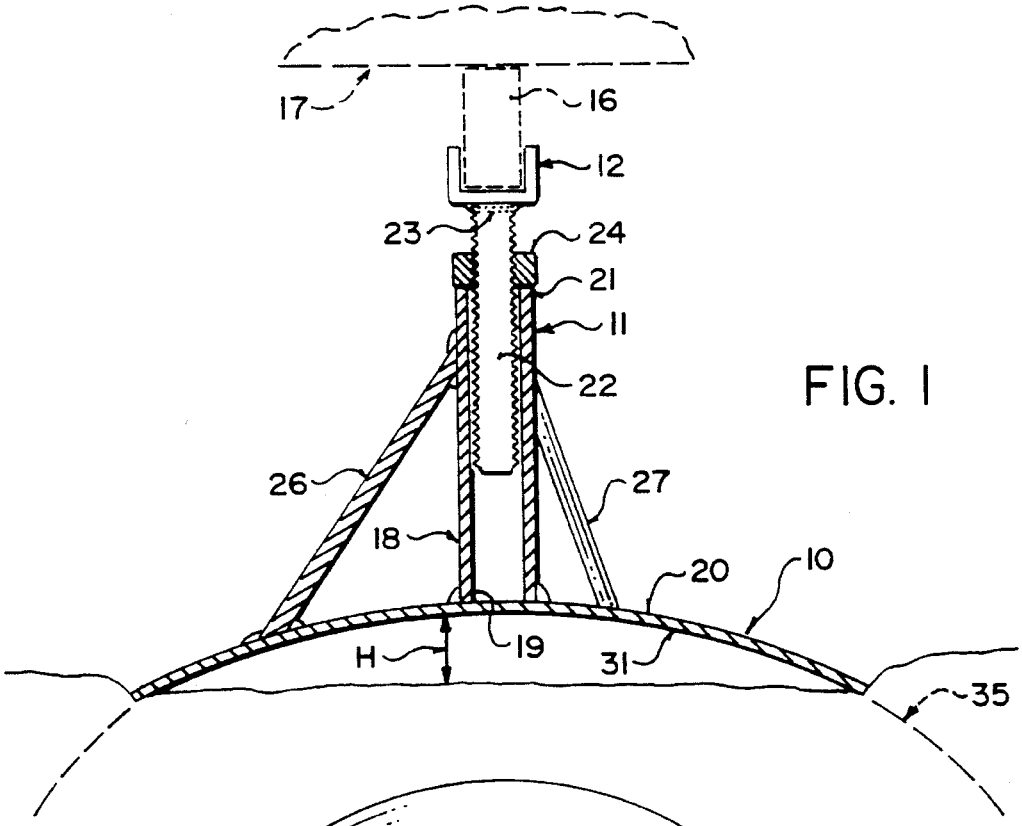
FIG. 1 is a vertical cross sectional view through a support foundation according to the present invention.
Figure 2:
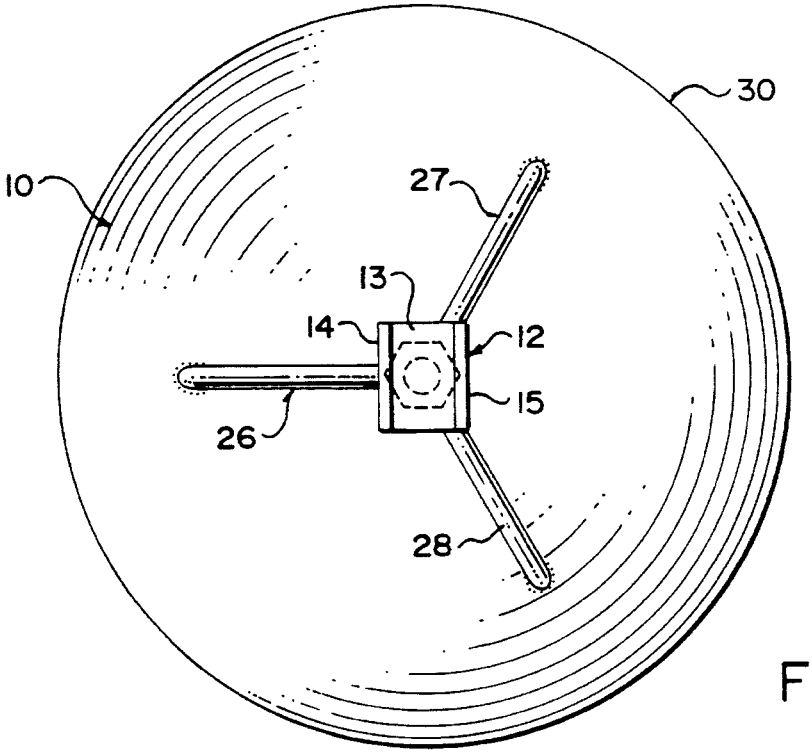
FIG. 2 is a top plan view of the support foundation of FIG. 1.

The support foundation shown in FIGS. 1 and 2 comprises a base pad 10 and a support member 11 mounted on the base pad and standing upwardly therefrom. At an upper end of the support member is provided a building structure support element 12 in the form of a channel member having a flat base 13 and a pair of upstanding sides 14 and 15 for receiving therebetween a joist 16 shown in phantom of a building structure 17.

The support member 11 comprises a sleeve 18 having a lower end 19 welded to an upper surface 20 of the base pad 10. The sleeve stands vertically upwardly from a centre of the base pad with a sleeve having an open upper end 21. Within the sleeve is mounted a threaded rod 22 which has a diameter such that it is a sliding fit within the inside surface of the sleeve so as to be held coaxial with the sleeve. The channel member 12 is welded onto an upper end 23 of the threaded rod so that the base plate 13 of the channel member is at right angles to the threaded rod and lies horizontal. A nut 24 is threaded onto the threaded rod so that its position longitudinally of the threaded rod can be adjusted by rotation of the nut around the threaded rod. The diameter of the nut is arranged so that it engages and abuts the end face 21 of the sleeve thus locating the axial position of the threaded rod within the sleeve to hold the channel member 12 at a required height spaced upwardly from the upper surface of the base pad.

The sleeve 18 is supported in vertical position relative to the base plate by three inclined support struts 26, 27 and 28 arranged at equi distant spacing around the sleeve and extending from an upper part of the sleeve outwardly toward a periphery of the base pad. The support struts and the sleeve are all welded to the upper surface of the base pad.

The base pad is circular in plan view including a circular outer periphery 30 and a lower surface 31 opposite to the upper surface 20. The base pad is formed as a smoothly curved part spherical element thus defining a space H underneath the domed base pad supporting the sleeve 18 spaced away from the nominal position of a surface of the ground which lies in a plane containing the periphery 30 of the base pad.

In practice the diameter of the base pad lies in the range one foot to three feet depending upon the loads to be applied. The diameter of the sphere from which the base pad is formed is such that the height H is of the order of 1.5 to 6 inches.

In operation, the base pad is simply placed upon the ground and under load gradually is compressed onto the ground so as to squeeze soil into the domed concave area underneath the lower surface 31. This action thus grasps a domed section 35 of the soil so that any sinking of the base pad requires that the domed portion 35 of the soil is compressed. The downwardly turned edges of the domed base pad thus prevent or tend to prevent the soil from slipping out from underneath the base pad and thus the soil tends to be maintained underneath the base pad to maintain and hold the domed section 35 in place, Also there is less tendency for the domed base pad to tilt to oneside since again it is necessary for the soil to be squeezed out from underneath the domed pad in such a tilting action.

In the event that sinking or tilting of the pad does occur, the height of the channel member 12 supporting the joist 16 can be adjusted simply by rotating the nut 24.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A support foundation for a building structure comprising a soil base, a base pad placed directly on the soil base, an upstanding support member attached to the base pad, support means at an upper end of the support member for engaging and supporting the building structure and brace means extending from the support member to the base pad and arranged such that the whole of the weight applied to the support means by the building structure is transmitted through the brace means and the support member to the base pad, the base pad being circular in plan view having a domed shape to define a convex upper surface and a concave lower surface resting on the soil surface, the soil base having a soil surface which is compressed by the base pad and forms a domed convex surface extending into the concave lower surface.

2. The foundation according to claim 1 including means for adjusting the height of the support means relative to the base pad.

3. The foundation according to claim 1 wherein the support member includes a threaded rod, a sleeve slidable over the threaded rod and a nut on the threaded rod for locating an end of the sleeve to adjust a height of the support member relative to the base pad.

4. The foundation according to claim 3 wherein the sleeve is mounted on the base pad and wherein the rod is slidable longitudinally of the sleeve, the rod having said support means at an upper end thereof.

5. The foundation according to claim 4 wherein the brace means comprises a plurality of support struts attached between an upper part of the sleeve and the base pad.

6. The foundation according to claim 5 wherein each of the support struts and the sleeve is welded to the upper surface of the base pad.

7. The foundation according to claim 1 wherein the support means comprises a channel member defining an upper open face for receiving a lower part of a wooden joist.

8. The foundation according to claim 1 wherein the base pad is shaped so as to form a smoothly curved part spherical surface.

* * * * *